US006722821B1

(12) United States Patent
Perko et al.

(10) Patent No.: US 6,722,821 B1
(45) Date of Patent: Apr. 20, 2004

(54) HELICE PIER POST AND METHOD OF INSTALLATION

(76) Inventors: Howard A. Perko, 727 Laport Ave., Fort Collins, CO (US) 80521; Stanley J. Rupiper, P.O. Box 465, Tahoma, CA (US) 96142

( * ) Notice: Subject to any disclaimer, the term of this patent is extended or adjusted under 35 U.S.C. 154(b) by 0 days.

(21) Appl. No.: 10/041,961

(22) Filed: Jan. 4, 2002

(51) Int. Cl.[7] ..... E02D 7/28; E02D 5/74

(52) U.S. Cl. ..... 405/249; 52/155

(58) Field of Search ..... 405/249, 232, 405/233, 241, 266; 248/156, 545; 52/155, 157, 161

(56) References Cited

U.S. PATENT DOCUMENTS

| | | | | |
|---|---|---|---|---|
| 5,066,168 A | * | 11/1991 | Holdeman | 405/249 |
| 5,904,447 A | * | 5/1999 | Sutton et al. | 405/263 |
| 5,919,005 A | * | 7/1999 | Rupiper | 405/244 |
| 6,128,867 A | * | 10/2000 | MacKarvich | 52/157 |
| 6,142,712 A | * | 11/2000 | White et al. | 405/249 |
| 6,272,798 B1 | * | 8/2001 | Cockman | 52/155 |

FOREIGN PATENT DOCUMENTS

| | | | | |
|---|---|---|---|---|
| JP | 09273373 A | * | 10/1997 | E21B/11/00 |

* cited by examiner

*Primary Examiner*—Heather Shackelford
*Assistant Examiner*—Lisa M. Saldano
(74) *Attorney, Agent, or Firm*—Edwin H. Crabtree; Ramun L. Pizzarro; Donald W. Margolis

(57) ABSTRACT

A helice pier post used for rotating into a ground surface for holding various structural items upright on the top thereof. The structural items may be a light post, a fence post, a building beam or column, a pier, a sound barrier and like items. The helice pier post broadly includes a top mounting plate, a hollow tubular casing, a first pipe shaft with a first helice mounted thereon. The mounting plate is welded to a top portion of the tubular casing. Also, the plate is welded to an upper end of the first pipe shaft. The first pipe shaft is centered inside and disposed along the length of the casing. An outer diameter of the first helice can be welded to an inner diameter of a bottom portion of the casing. A lower end of the first shaft can be coupled to an upper end of the second pipe shaft. A lower end of the second pipe shaft is attached to the second helice. The first and second helice are used for guiding the pier post into the ground surface with the top mounting plate resting next to or near the top of the ground surface.

19 Claims, 1 Drawing Sheet

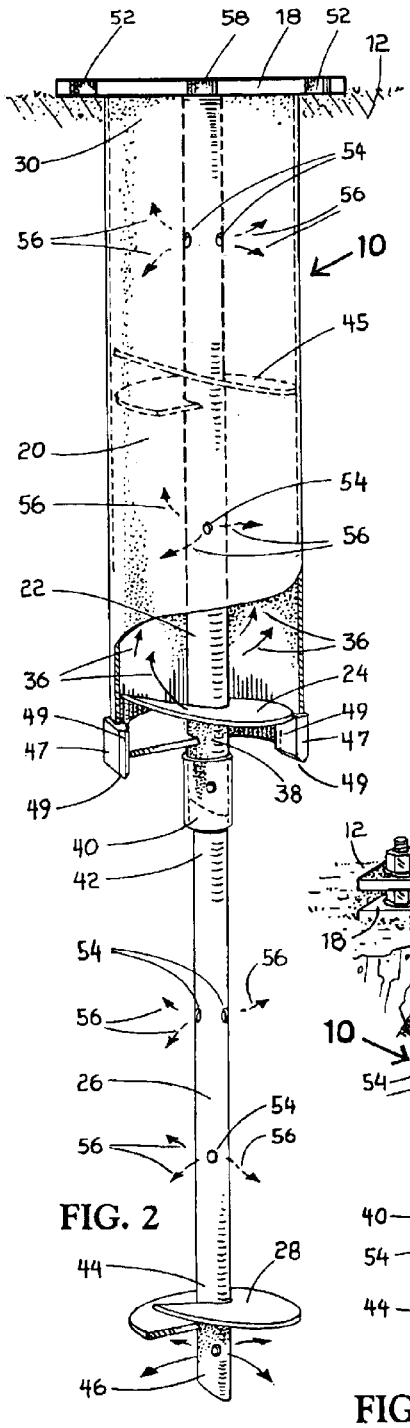
FIG. 2
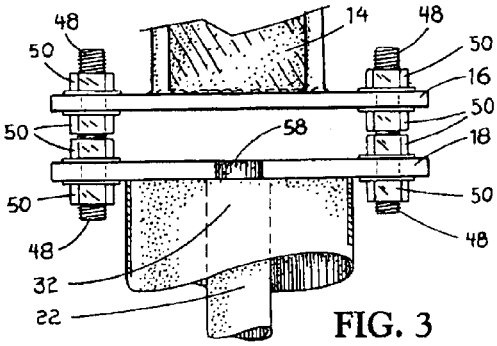
FIG. 3
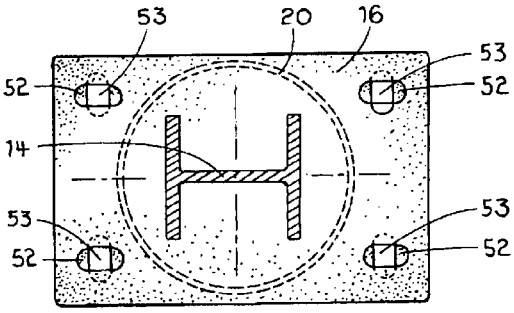
FIG. 4
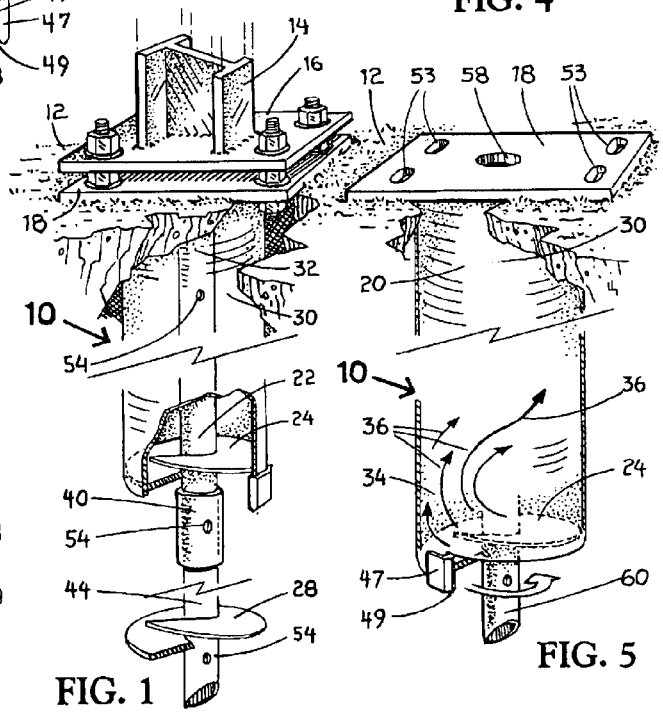
FIG. 1
FIG. 5

HELICE PIER POST AND METHOD OF INSTALLATION

This application is based on an earlier filed provisional patent application having the same title and filed on Jan. 3, 2001, Serial No. 09/259,609.

BACKGROUND OF THE INVENTION (a) Field of the Invention

This invention relates to a ground anchor device used for supporting various types of structures thereon and more particularly, but not by way of limitation, to a helice pier post rotated into a ground surface with a structure mounted on top of the helice pier post and a method of installing the pier post.

(b) Discussion of Prior Art

Heretofore, there have been a variety of ground anchor devices used for soil stabilization. In particular, U.S. Pat. No. 6,058,662 to Howard A. Perko and U.S. Pat. Nos. 5,904,447, 5,919,005 and 5,934,836 to Stanley J. Rupiper et al. disclose recent anchor devices using helical piers for stabilizing soil, securing building foundations and other structures. Also, the patents cited during the prosecution of the above patents are incorporated herein by reference.

Today, a number of United States companies manufacture foundation anchors having an enlarged hollow pipe shaft with a fixture mounting plate attached to the top of the pipe shaft. The pipe shaft has a cableway precut in its side for wiring lighting fixtures attached to the top of the mounting plate. A helix is attached around a circumference of a lower portion of the pipe shaft. The helix is used for rotating the foundation anchor into a ground surface. The foundation anchors can be used for securing light poles, telephone poles, road signs and the like thereon. These types of foundation anchors do not incorporate the use of one or more cutting teeth or cutting shoes attached to a tubular casing for reducing drag and torque during the installation of the subject helice pier post as described herein.

In U.S. Pat. No. 5,066,168 to Holdeman, a foundation earth anchor and installation unit is described having a hollow cylindrical foundation support. The foundation support is driven into a ground surface using an installation drive component with a helix. The installation drive component is releasably coupled to the cylindrical foundation support. Once the foundation support is driven into the ground surface, the rotation of the helix is reversed and the installation drive component is removed from the ground surface and disconnected from the foundation support. This patent does not disclose or teach a combination of structure making up a helice pier post, which is left permanently in the ground for supporting various types of structures under vertical and lateral loads.

None of the prior art ground anchor devices and foundation supports described in the cited patent references provide the unique features, structure, and advantages of the subject helice pier post as described herein.

SUMMARY OF THE INVENTION

In view of the foregoing, it is a primary objective of the subject invention to provide a helice pier post that can be rotated into a ground surface with the top of the post used for securing various types of building structures, piers, beams, columns, fence posts, light posts, sound barriers, signage and like items.

Another object of the invention is to provide for a method of installing a helice pier post having a hollow tubular casing with compacted soil therein and providing a foundation for structures subject to lateral and vertical loads such as sound barriers, fencing, signage and the like.

Still another object of the invention is the pier post may include a plurality of pier shafts having lengths of 5 feet or greater. By adding additional pier shafts, the overall length of the pier post can be increased to 20 to 30 feet and greater as the pier post is advanced into a ground surface.

Yet another object of the invention is, by the nature of it's construction, the pier post can be used in unstable ground conditions and used for providing lateral support for foundations, buildings and other structures.

Another object of the invention is to provide a method of installation using one or more cutting shoes, cutting bits and the like for greatly reducing installation torque and drag as the pier post is rotated into various types of ground conditions. This important feature allows for reduced cost by decreasing the thickness of a hollow tubular casing attached to a first pipe shaft with a first helice.

Still another object of the pier post is the use of one or more helice disposed inside the hollow tubular casing along with compacted dirt received therein for providing resistance to crushing of the casing under lateral loads. Again this is another feature that allows for reduction is the thickness of the tubular casing and reduced cost.

A further object of the pier post is the use of a top mounting plate having a plurality of slotted openings for adjusting the attachment of various types of structures on the mounting plate.

A further object of the pier post is the first pipe shaft and added pipe shaft can be hollow along with grout holes disposed along the length of the shafts. The holes in the shafts for introducing pumped grout into the tubular casing and the surrounding ground after the installation of the pier post.

The helice pier post includes a top mounting plate, a hollow tubular casing, a first pipe shaft with a first helice mounted thereon. The helice pier post can also include a second pipe shaft with a second helice mounted thereon. The mounting plate is welded to a top portion of the tubular casing. Also, the plate is welded to an upper end of the first pipe shaft. The mounting plate is used for receiving a lower end of a pier, column, post, etc. thereon. The first pipe shaft is centered inside and disposed along the length of the casing. The inner diameter of the tubular casing surrounds the outer diameter of the first pipe shaft. An outer diameter of the first helice can be welded to an inner diameter of a bottom portion of the casing. The tubular casing receives compacted dirt therein as the pier post is screwed into the ground surface. The dirt received inside the casing provides additional strength to the pier post when the pier post is under collinear and/or lateral loads. A lower end of the first shaft is coupled to an upper end of the second pipe shaft. A lower end of the second pipe shaft is attached to the second helice. The pier post can also include oner or more additional helice disposed between the first helice and the top mounting plate inside the tubular casing. The helices are used for guiding and threading the pier post into the ground surface with dirt compacted inside the casing with the top mounting plate resting next to or near the top of the ground surface. The first and second shafts can be hollow with grout holes along the length of the shafts for pumping grout into the casing and surrounding ground after the pier post is installed for added strength and stability.

These and other objects of the present invention will become apparent to those familiar with ground and soil stabilization devices and helical piers used in stabilizing soil, building foundations, concrete slabs and other structures when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which:

FIG. 1 is a perspective view of the helice pier post. The pier post is illustrated rotated into a ground surface. A portion of a "H" beam is shown mounted on top of the pier post.

FIG. 2 is a side view of the pier post with a portion of the tubular casing cut away and illustrating a lower portion of a first pipe shaft with a first helice mounted thereon.

FIG. 3 is a side view of a top mounting plate attached to a top portion of the tubular casing. A beam mounting plate and a portion of a "H" beam is shown threadably attached to a top mounting plate.

FIG. 4 is a top view of the beam mounting plate and the "H" beam shown in FIG. 3.

FIG. 5 is a perspective view of an alternate embodiment of the pier post without the use of a first pipe shaft. The tubular casing is shown with a cutting shoe attached to a lower portion of the casing and next to the leading edge of the first helice.

DESCRIPTION OF THE PREFERRED EMBODIMENTS

In FIG. 1, a perspective view of the helice pier post is shown and having a general reference numeral 10. The pier post 10 is illustrated rotated into a ground surface 12. A portion of a "H" beam 14 is shown attached to a support mounting plate 16. The support mounting plate 16 is bolted to the top of the pier post 10.

Broadly, the helice pier post 10 includes a top mounting plate 18, a hollow tubular casing 20, a first pipe shaft 22 with a first helice 24 mounted thereon. The pier post 10 can also include a second pipe shaft 26 with a second helice 28 mounted thereon along with added shafts and helices depending on the depth of installation required.

Referring now to both FIGS. 1 and 2, the mounting plate 18 is welded to a top portion 30 of the tubular casing 20. Also, the plate 18 is welded to an upper end 32, shown in dashed lines, of the first pipe shaft 22. The mounting plate 16, is also used for receiving a lower end of a pier, column, post and other building structures thereon.

The first pipe shaft 22 is centered inside and disposed along the length of the tubular casing 20. The inner diameter of the tubular casing 20 surrounds the outer diameter of the first pipe shaft 22. A bottom portion 34 of the casing 20 has been cut away in FIGS. 1 and 2 to illustrate this feature. An outer diameter of the first helice 24 is welded to an inner diameter of the lower portion 34 of the tubular casing 20. The tubular casing receives dirt, as indicated by arrows 36, therein as the pier post 10 is screwed into the ground surface 12. The addition of the dirt 36 received inside the casing 20 provides for added strength and stability to the pier post 10 and particularly when the pier post is under lateral loads.

A lower end 38 of the first shaft 22 is coupled to an upper end 42 of the second pipe shaft 26 using a pier shaft coupling 40. A lower end 44 of the second pipe shaft 26 includes a pointed end 46. The pointed end 46 is used for ease in driving the second helice 28 into the ground surface 12. Also, the pointed end 46 can be used with another pipe shaft coupling 40 for joining the second pier shaft 26 to an additional pipe shaft for increasing the overall length of the helice pier post 10. For example, by joining various lengths of pipe shafts, the pier post 10 can be 10 to 20 feet in length and greater.

Obviously, the first and second helices 24 and 28 are used for guiding and threading the pier post 10 into the ground surface 12 with dirt compacted inside the casing 20 as the pier post is driven into the ground. As an added feature, one or more additional helices 45, shown in dashed lines can be attached to the first pipe shaft 22 between the first helice 24 and the top mounting plate 18 for providing additional strength and stability to the tubular casing 20 and compacting the dirt inside the casing. The top mounting plate 18 can be installed near or rest next to the top of the ground surface 12 as shown in the drawings.

Also shown in FIGS. 1, 2 and 5 are one or more vertical cutting shoes 47 with cutting edge 49, which is attached to a portion of the tubular casing 20 or can be attached to a portion of the first helice 24. The cutting shoe 47 or cutting bit aids in cutting through the ground surface as the helices 24 and 28 are rotated into the ground. Also, the use of the cutting shoe 47 is important for reducing drag and torque along the casing 20 during installation of the pier post 10 when gravel, shale, clay and other difficult soil conditions are encountered. Also, through the use of one or more cutting shoes 47, the casing 20 can be constructed of a thinner gage material, thus reducing the cost of the casing and cost of installation. While the cutting shoe 47 is shown in the drawings, it can be appreciated that other types of ground cutting devices can be used equally well in conjunction with the pier post 10 without departing from the spirit and scope of the invention.

In FIG. 3, a side view of the top mounting plate 18 is shown attached to the top portion 32 of the tubular casing 20. The support mounting plate 16 and a portion of the "H" beam 14 are shown attached to the top mounting plate 18 using a plurality of all thread bolts 48 and nuts 50. The all thread bolts 48 are received in elongated slotted support mounting plate bolt openings 52 in the four corners of the support mounting plate 16 and elongated slotted top mounting plate bolt openings 53 in the top mounting plate 18.

A length of the elongated slotted bolt openings 52 is preferably perpendicular to a length of the elongated slotted bolt openings 53, as shown in FIG. 4. This feature of the bolt openings 52 and 53 allow for quick adjustment in different directions of the various structural items installed on the two mounting plates. While the all thread bolts 48 and the nuts 50 are shown, it can be appreciated that various types of fasteners and connectors can be used for securing different types of building structures on top of the top mounting plate 18.

In FIG. 4, a top view of the beam mounting plate 16 and the bottom portion of the "H" beam 14 are shown. In this view, the support mounting plate 16 is shown with the bolt openings 52 and the bolt openings 53 in the top mounting plate 18 for receiving the all tread bolts 48 shown in FIG. 3.

It should be mentioned that the first and second pipe shafts 22 and 24 and the pier shaft coupling 40 can be hollow with a circular or non-circular cross section. Also, the pipe shafts 22 and 24 can include a plurality of grout holes 54 shown in dashed lines for pumping grout, indicated by arrows 56, inside the casing 20 and into the surrounding ground for added strength and stability to the installation of the pier post 10. Also, a mounting plate opening 58 in the top mounting plate 18 can be provided for pumping the grout 56 into the shafts 22 and 24. Further, the plate opening 56 can be used for inserting a drill rod, rebar, piping and the like into the hollow shafts.

In FIG. 5, a perspective view of an alternate embodiment of the pier post 10 is illustrated. In this example, the pier post 10 is shown without the first pipe shaft 22. The first helice 24 is attached to the bottom portion 34 of the tubular casing 20. The helice 24 can include a downwardly extending guide point 60 to aid the rotation of the pier post.

A cutting shoe 47 with cutting edge 49 is disposed next to the leading edge of the first helice 24 for cutting through the ground surface 12 as the pier post 10 is rotated into the ground surface. The overall thickness of the shoe 47 is greater than the thickness of the tubular casing 20. As mentioned above, the cutting shoe 47 greatly reduces drag and torque for ease in installation. One or more cutting shoes 47 with cutting edges 49 can be attached to the tubular casing 20 or the first helice 24 depending on the ground conditions and depth of installation of the pier post 10. Also note in this drawing that the top mounting plate 18 includes the plate opening 58, which can be used for pumping grout 56 into the inside of the tubular casing 20 for providing added strength to the pipe post 10.

In operation, the pier post 10, as shown in the drawings, is rotated into the top of the ground surface 12 using the top mounting plate 18 releasably attached to a piece of heavy construction equipment. As the tubular casing 20 is rotated, the first helice 24 slices and rotates into the ground with dirt 36 gathered and compacted inside the casing. Also, the cutting shoe 47 or shoes 47 can be attached to the casing 20 or the first helice 24 for reducing the rotational torque and drag as the casing advances into the ground. For added stability and strength the second pipe shaft 26 with second helice 28 can be added to the first pipe shaft 22. Also, as mentioned under the discussion of FIG. 5, the pier post 10 can be used without the first pipe shaft 22 and with a cutting shoe 47 attached to the casing 20 next to the leading edge of the first helice 24.

When the pier post 10 has been advanced into the ground surface 12 and the top mounting plate 18 is disposed near or next to the top of the ground, the support mounting plate 16 can then be adjusted on and bolted to the top of the top mounting plate 18 for supporting various types of structural items thereon. As mentioned above and depending on the ground conditions, the plate opening 58 can be used for pumping grout 56 under pressure through the hollow first pipe shaft 22 and out grout holes 54 for adding added strength and rigidity to the pier post 10. Also, grout 56 can be pumped out of grout holes 54 in the second pipe shaft 26, if the second pipe shaft 26 is used, into the surrounding ground for added stability to the pier post.

While the invention has been particularly shown, described and illustrated in detail with reference to the preferred embodiments and modifications, it should be understood by those skilled in the art that equivalent changes in form and detail may be made without departing from the true spirit and scope of the invention as claimed except as precluded by the prior art.

The embodiments of the invention for which as exclusive privilege and property right is claimed are defined as follows:

1. A helice pier post used for rotating into a ground surface and for supporting various structural items on the top thereof, the pier post comprising:

a top mounting plate;

a hollow tubular casing having an upper end permanently attached to said top mounting plate; and a first pipe shaft with a first helice mounted thereon, said first pipe shaft having an upper end attached to said top mounting plate, said first pipe shaft received inside said tubular casing and along the length thereof wherein said first helice is attached to an inner diameter of said tubular casing.

2. The pier post as described in claim 1 wherein said first pipe shaft has a lower end, said first helice mounted on the lower end of said first pipe shaft.

3. The pier post as described in claim 1 further including a second pipe shaft coupled to said first pipe shaft, said second pipe shaft having a second helice thereon.

4. The pier post as described in claim 3 wherein said second pipe shaft is hollow, said second pipe shaft having a plurality of grout holes along the length thereof, said grout holes adapted for receiving grout therethrough and pumped under pressure from inside said hollow second pipe shaft into the surrounding ground.

5. The pier post as described in claim 1 further including at least one added helice attached along a length of said first pipe shaft and disposed between said first helice and said top mounting plate inside said tubular casing.

6. The pier post as described in claim 1 further including at least one cutting shoe attached to said tubular casing, said cutting shoe reducing torque and drag as the pier post is rotated into the ground surface.

7. The pier post as described in claim 1 wherein said first pipe shaft is hollow, said first pipe shaft having a plurality of grout holes along the length thereof, said grout holes adapted for receiving grout therethrough and pumped under pressure from inside said hollow first pipe shaft into said tubular casing.

8. The pier post as described in claim 1 wherein said top mounting plate includes a plurality of elongated slotted top mounting plate bolt openings therein for allowing adjustment of bolts thereon when securing the structural item on top of said top mounting plate.

9. The pier post as described in claim 8 further including a support mounting plate having a plurality of elongated slotted support mounting plate bolt openings for allowing adjustment of bolts thereon and attachment to said top mounting plate, a length of the elongated support mounting plate bolt openings perpendicular to a length of the elongated top mounting plate bolt openings.

10. A helice pier post used for rotating into a ground surface and for supporting various structural items on the top thereof, the pier post comprising:

a top mounting plate adapted for receiving a structural item thereon;

a hollow tubular casing having an upper end and a lower end, the upper end permanently attached to said top mounting plate;

a first helice attached to the inner diameter of the lower end of said tubular casing; and cutting means attached to the lower end of said tubular casing and next to said first helice for reducing torque and drag as the pier post is rotated into the ground surface.

11. The pier post as described in claim 10 wherein said cutting means is a cutting shoe with cutting edge, said cutting shoe having an overall thickness greater than a thickness of said tubular casing, said cutting shoe attached to said tubular casing and disposed approximately vertically between a leading edge and a trailing edge of said first helice.

12. The pier post as described in claim 10 wherein said cutting means is a plurality of cutting shoes with cutting edges, said cutting shoe attached to a lower portion of said tubular casing with one or more of said cutting shoes disposed near said first helice.

13. The pier post as described in claim 10 wherein said top mounting plate includes a plurality of elongated slotted top mounting plate bolt openings therein for allowing adjustment of bolts thereon when securing the structural item on top of said top mounting plate.

14. The pier post as described in claim 13 further including a support mounting plate having a plurality of elongated slotted support mounting plate bolt openings for allowing adjustment of bolts thereon and attachment to said top mounting plate, a length of the elongated support mounting plate bolt openings perpendicular to a length of the elongated top mounting plate bolt openings.

15. A method of installing a helice pier post into a ground surface and for supporting various structural items on the top thereof, the pier post having a top mounting plate permanently mounted on a hollow tubular casing and a first helice attached to the casing and at least one cutting shoe attached to the casing, the steps comprising:

rotating the top mounting plate, the tubular casing with cutting shoe and the first helice into the ground surface;

compacting dirt inside the tubular casing using the first helice as the first helice and tubular casing are rotated into the ground surface; and advancing the tubular casing with cutting shoe and the first helice into the ground surface and positioning the top mounting plate next to the top of the ground surface.

16. The method as described in claim 15 further including a step of attaching a plurality of cutting shoes to the tubular casing prior to rotating the top mounting plate and tubular casing into the ground, the cutting shoes reducing torque as the first helice and the tubular casing are advanced into the ground surface.

17. The method as described in claim 15 further including a step of pumping grout through a plate opening in the top mounting plate and into the inside of the tubular casing for added strength and rigidity to the pier post and after the step of positioning the top mounting plate next to the top of the ground surface.

18. The method as described in claim 15 further including a step of adjustably mounting a structural item on top of the top mounting plate after the step of positioning the top mounting plate next to the top of the ground surface.

19. The method as described in claim 15 further including a step of positioning the cutting shoe with cutting edge approximately vertically between the leading edge and trailing edge of the first helice.

* * * * *